US008820566B2

(12) United States Patent
Ude

(10) Patent No.: US 8,820,566 B2
(45) Date of Patent: Sep. 2, 2014

(54) VENTILATED BARREL COVER SYSTEM

(76) Inventor: Scott C. Ude, Houston, TX (US)

( * ) Notice: Subject to any disclaimer, the term of this patent is extended or adjusted under 35 U.S.C. 154(b) by 245 days.

(21) Appl. No.: 13/402,396

(22) Filed: Feb. 22, 2012

(65) Prior Publication Data

US 2013/0092687 A1 Apr. 18, 2013

Related U.S. Application Data

(60) Provisional application No. 61/445,134, filed on Feb. 22, 2011.

(51) Int. Cl.

| | |
|---|---|
| ***B65D 51/18*** | (2006.01) |
| ***B65D 51/16*** | (2006.01) |
| ***B65D 25/00*** | (2006.01) |
| ***B65D 6/40*** | (2006.01) |
| ***B65D 90/22*** | (2006.01) |
| ***B65F 1/14*** | (2006.01) |

(52) U.S. Cl.

CPC ..... *B65F 1/1607* (2013.01); *B65F 2240/12* (2013.01); *B65F 2210/181* (2013.01); *B65F 2210/1121* (2013.01); *Y10S 220/908* (2013.01)

USPC ..... 220/367.1; 220/254.8; 220/366.1; 220/745; 220/908

(58) Field of Classification Search

USPC ..... 220/366.1, 367.1, 254.8, 745, 908, 913, 220/DIG. 27

See application file for complete search history.

(56) References Cited

U.S. PATENT DOCUMENTS

| | | | | |
|---|---|---|---|---|
| 2,678,764 | A * | 5/1954 | Carlson | 141/390 |
| 4,765,579 | A * | 8/1988 | Robbins et al. | 248/101 |
| 4,984,561 | A * | 1/1991 | Warrington | 435/290.1 |
| 5,065,891 | A * | 11/1991 | Casey | 220/495.08 |
| 5,634,566 | A * | 6/1997 | Jansen et al. | 220/254.8 |
| 6,505,751 | B1 * | 1/2003 | Haas | 220/4.11 |

* cited by examiner

*Primary Examiner* — Fenn Mathew
*Assistant Examiner* — Andrew T Kirsch
(74) *Attorney, Agent, or Firm* — Michael S. Neustel

(57) ABSTRACT

A ventilated barrel cover system for effectively covering a barrel while allowing for ventilation of the contents of the barrel. The ventilated barrel cover system generally includes a base positionable upon an upper rim of a barrel, an upper opening extending through the base, and a cover removably attached to the base for selectively closing the upper opening. The base includes at least one vent for allowing ventilation of the interior of the barrel.

19 Claims, 11 Drawing Sheets

VENTILATED BARREL COVER SYSTEM

CROSS REFERENCE TO RELATED APPLICATIONS

I hereby claim benefit under Title 35, United States Code, Section 119(e) of U.S. provisional patent application Ser. No. 61/445,134 filed Feb. 22, 2011. The 61/445,134 application is currently pending. The 61/445,134 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to barrel covers and more specifically it relates to a ventilated barrel cover system for effectively covering a barrel while allowing for ventilation of the contents of the barrel.

2. Description of the Related Art

Any discussion of the related art throughout the specification should in no way be considered as an admission that such related art is widely known or forms part of common general knowledge in the field.

Containers to receive litter and recyclables are commonly utilized. However, such containers are typically specifically manufactured for the intended purpose resulting in an increased production cost. In addition, conventional containers for litter and recyclables often times do not provide for adequate ventilation of the interior contents which is desirable to remove any liquid within the contents.

Because of the inherent problems with the related art, there is a need for a new and improved ventilated barrel cover system for effectively covering a barrel while allowing for ventilation of the contents of the barrel.

BRIEF SUMMARY OF THE INVENTION

The invention generally relates to a barrel cover which includes a base positionable upon an upper rim of a barrel, an upper opening extending through the base, and a cover removably attached to the base for selectively closing the upper opening. The base includes at least one vent for allowing ventilation of the interior of the barrel.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
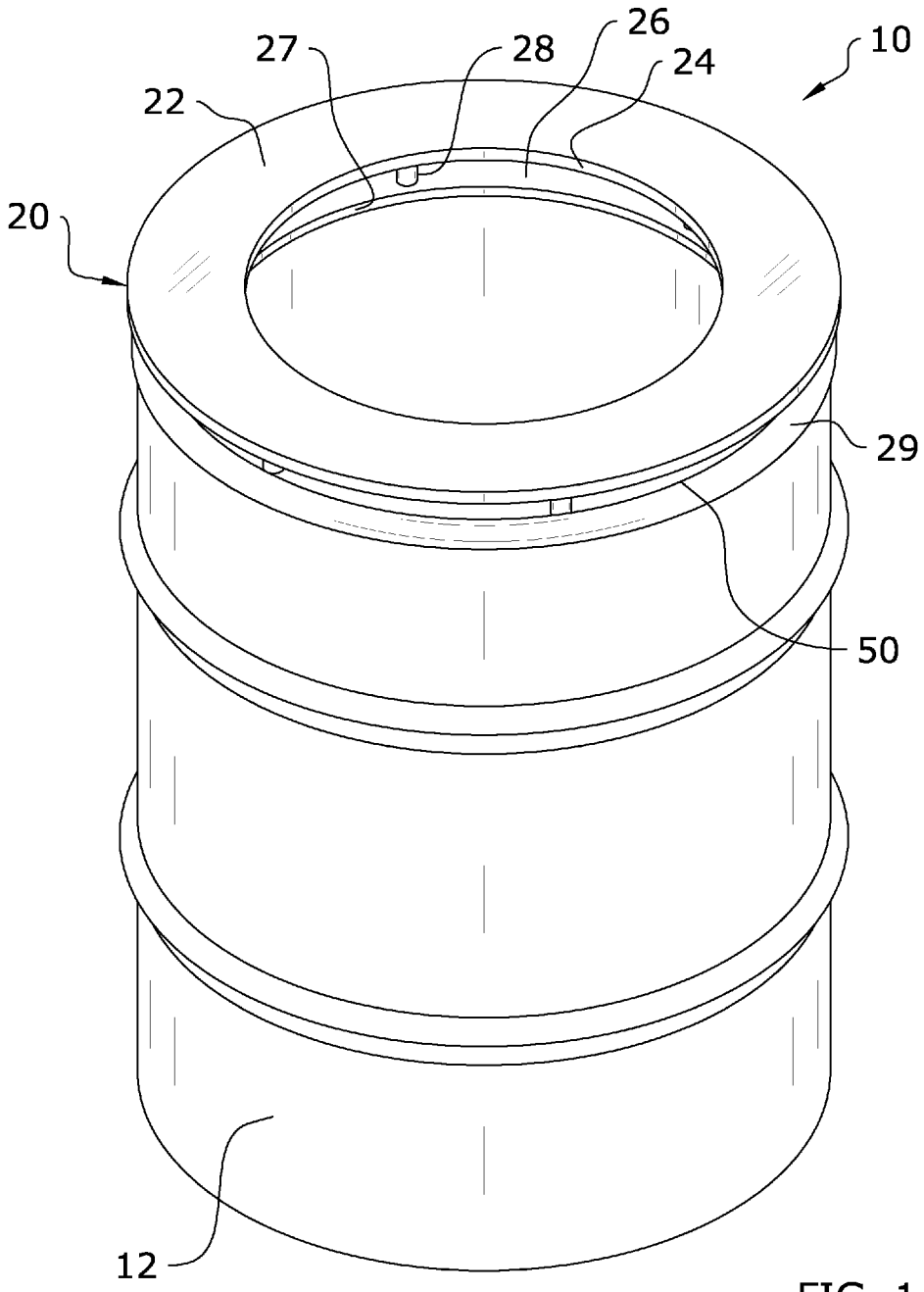
FIG. 1 is an upper perspective view of the base positioned upon the upper rim of a barrel.

A. Overview.

Turning now descriptively to the drawings, in which similar reference characters denote similar elements throughout the several views, FIGS. 1 through 12 illustrate a ventilated barrel cover system 10, which comprises a base 20 positionable upon an upper rim 14 of a barrel 12, an upper opening 24 extending through the base 20, and a cover 30 removably attached to the base 20 for selectively closing the upper opening 24. The base 20 includes at least one vent 50 for allowing ventilation of the interior of the barrel 12.

B. Barrel.

FIGS. 1, 2, 8, 9, 10 and 11 illustrate an exemplary barrel 12 having an upper rim 14 defining an upper opening 24. The barrel 12 may be comprised of any container having an upper opening 24 such as but not limited to a fifty-five gallon steel drum and the like. The barrel 12 may have various volumes and sizes. The barrel 12 may also be comprised of various types of materials such as but not limited to metal, plastic, wood or composite materials.

The barrel 12 is preferably comprised of a hollow cylindrical shaped structure that is self-supporting, however, the barrel 12 may be comprised of various other configurations capable of receiving a plurality of discarded items 16 (e.g. recyclable materials, aluminum cans, plastic bottles, glass bottles, paper, cardboard, waste material etc.). The barrel 12 may also be lined with a waste liner bag.

C. Base.

Figure 3:
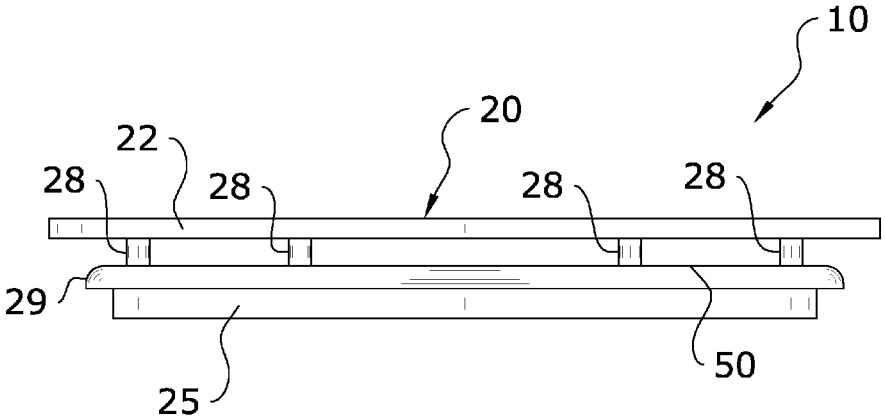
FIG. 3 is a side view of the base.
Figure 4:
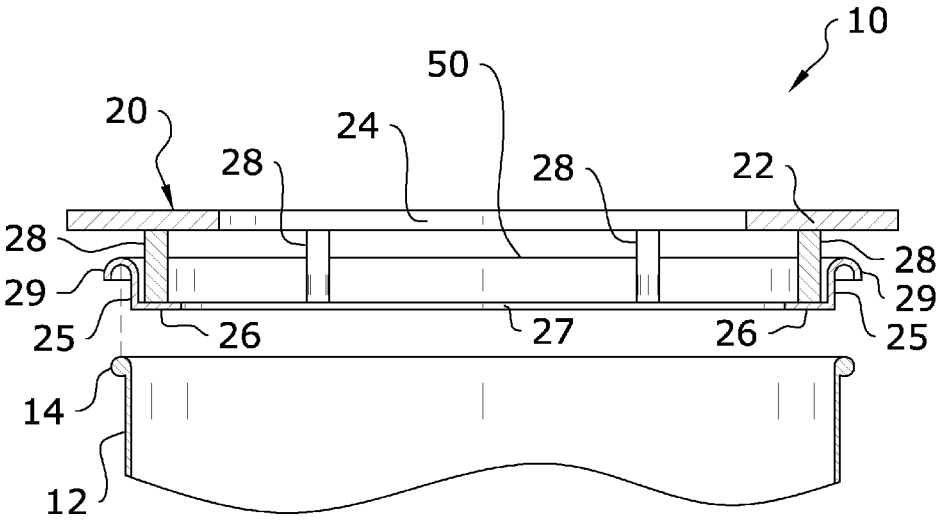
FIG. 4 is a side cutaway view of the base positioned above the barrel.
Figure 5:
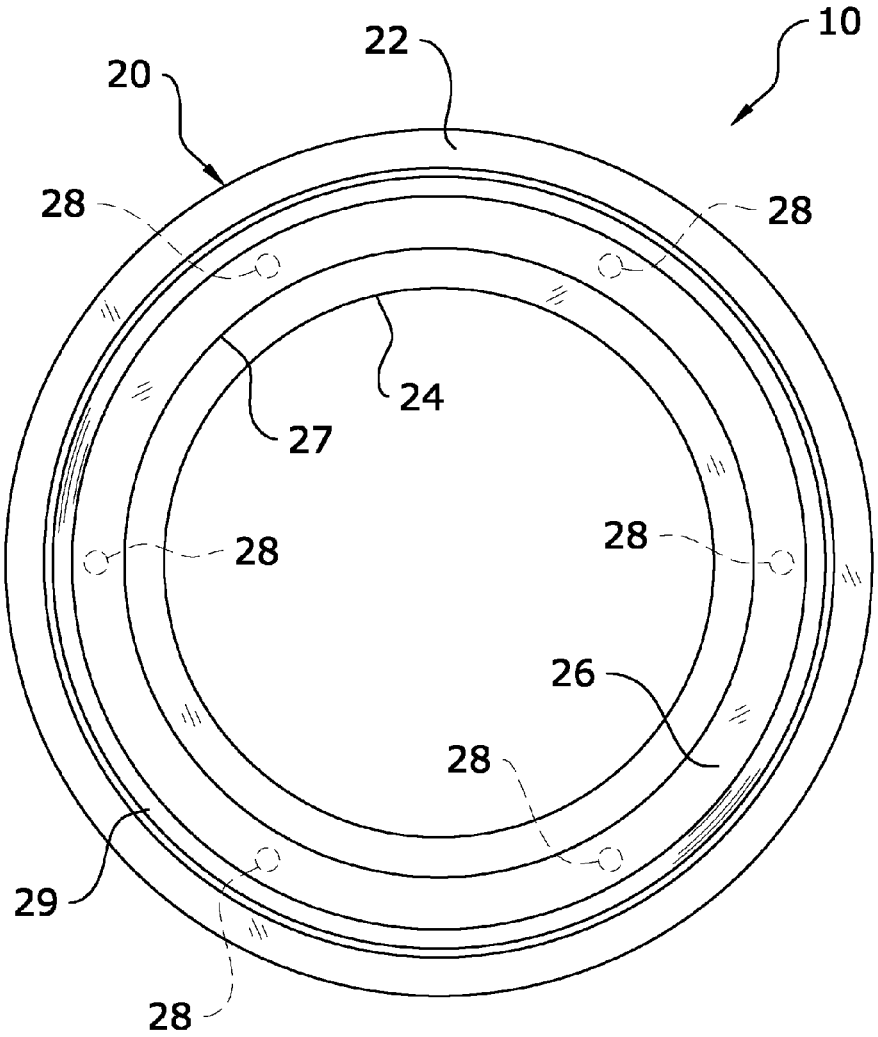
FIG. 5 is a bottom view of the base.
Figure 6:
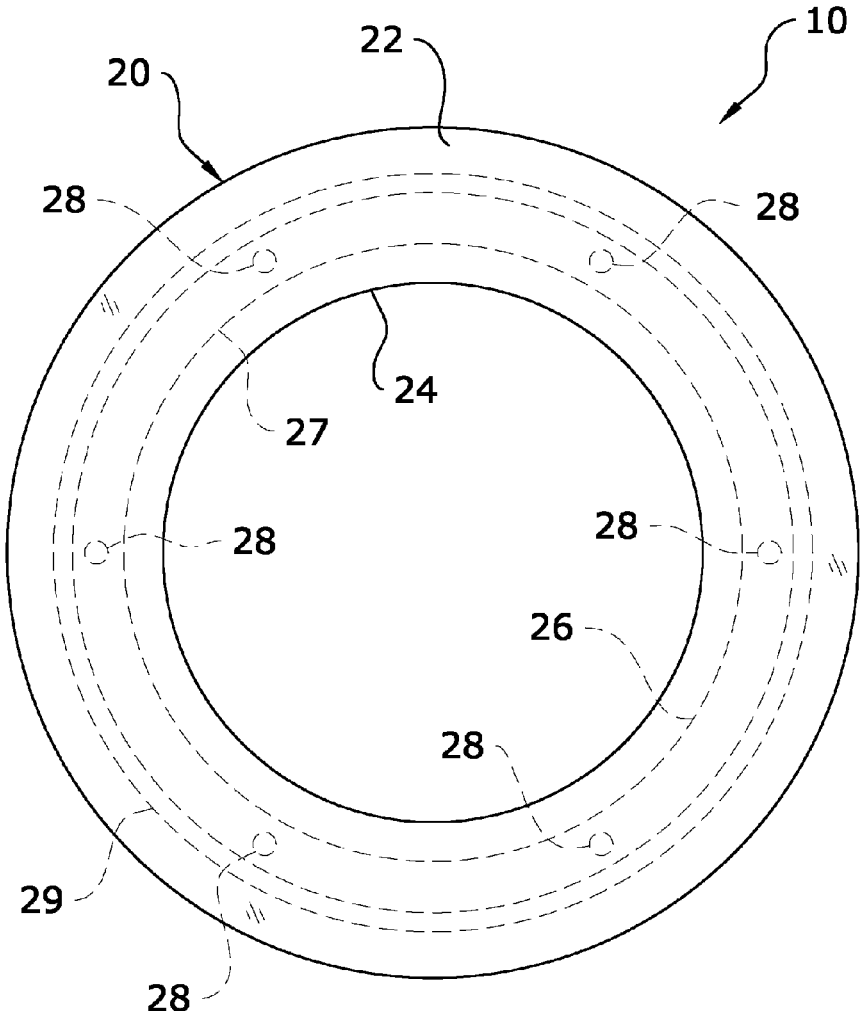
FIG. 6 is a top view of the base.
Figure 7:
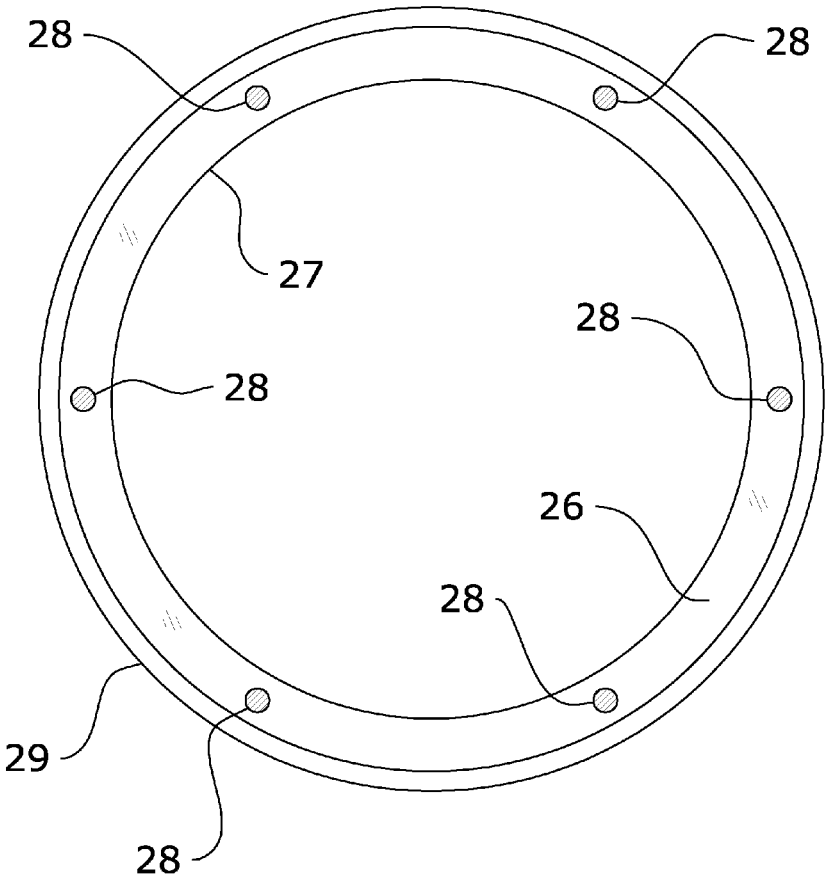
FIG. 7 is a cross sectional view taken along line 7-7 of FIG. 2.

FIGS. 1 through 11 illustrate the base 20 of the present invention. The base 20 includes an upper opening 24, wherein the upper opening 24 is adapted to receive various types and sizes of discarded items 16 to be deposited within the interior of the barrel 12. The upper opening 24 is preferably circular shaped as illustrated in FIGS. 5 and 6 of the drawings, however, the upper opening 24 may have various other shapes.

The base 20 is preferably removably positioned upon the upper rim 14 of the barrel 12. The base 20 may be semi-permanently secured to the barrel 12 by using a standard ring and bolt drum closure to discourage vandalism and theft. The base 20 may be comprised of various types of materials such as but not limited to plastic, metal, wood or composite materials.

The base 20 is formed to a shape and size to fit upon the upper rim 14 of the barrel 12. It is preferable that the base 20 be comprised of a circular shape (i.e. a ring structure) as most barrels 12 have a circular upper rim 14. For larger diameter barrels 12, the base 20 would correspondingly be increased in diameter and for smaller diameter barrels 12 the base 20 would correspondingly be decreased in diameter to correspond to the diameter of the upper rim 14 of the barrel 12.

Figure 2:
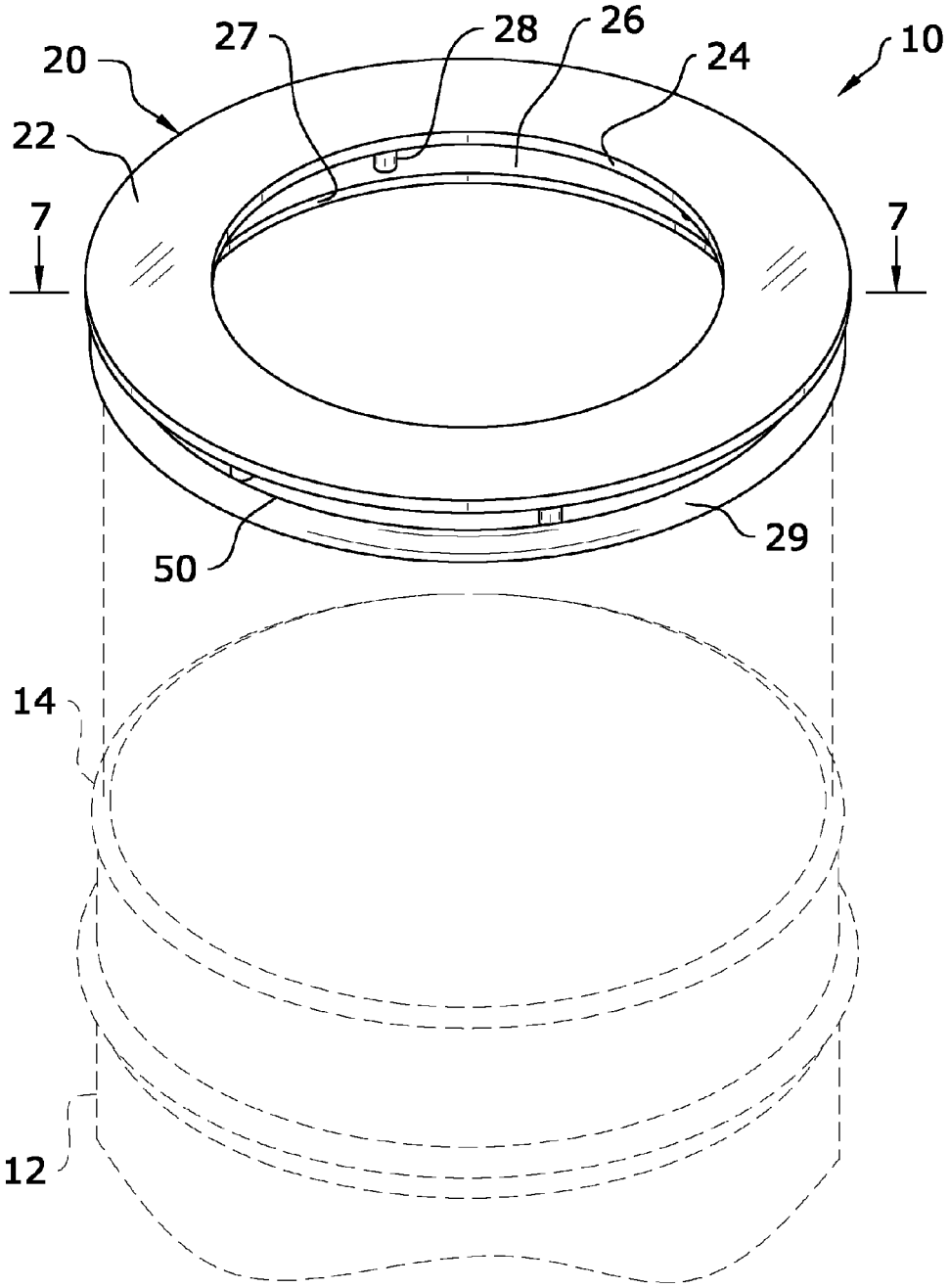
FIG. 2 is an exploded upper perspective view of the base with respect to a barrel.

The base 20 is comprised of a lower member having a lower opening 27 and an upper member 22 positioned above the lower member defining the vent 50, wherein the upper member 22 includes the upper opening 24 as illustrated in FIG. 2 of the drawings. The lower member and the upper member 22 are each preferably comprised of a ring structure. The upper member 22 and the lower member are preferably each comprised of a planar structure and are substantially parallel with respect to one another. The upper member 22 is preferably wider than the lower member and the barrel 12 as illustrated in FIGS. 4 and 10 of the drawings to prevent precipitation (e.g. rain, snow) from entering the vent 50 or the interior of the barrel 12.

As illustrated in FIGS. 5 and 6 of the drawings, the lower opening 27 and the upper opening 24 are preferably concentric with respect to one another. As best illustrated in FIGS. 4 and 5 of the drawings, the lower opening 27 is preferably smaller than the upper opening 24.

At least one support member extends between the lower member and the upper member 22 to support the upper member 22 above the lower member. It is preferable to have a plurality of support members 28 extending between the lower member and the upper member 22 to provide adequate support for the upper member 22 as illustrated in FIGS. 1 through 12 of the drawings. The plurality of support members 28 are preferably distally spaced about a perimeter portion of the lower member. The support members 28 are preferably comprised of vertical rod members to provide for increased ventilation of the interior of the barrel 12 by maximizing the size of the area of the vent 50, however, various other structures may be utilized.

Figure 10:
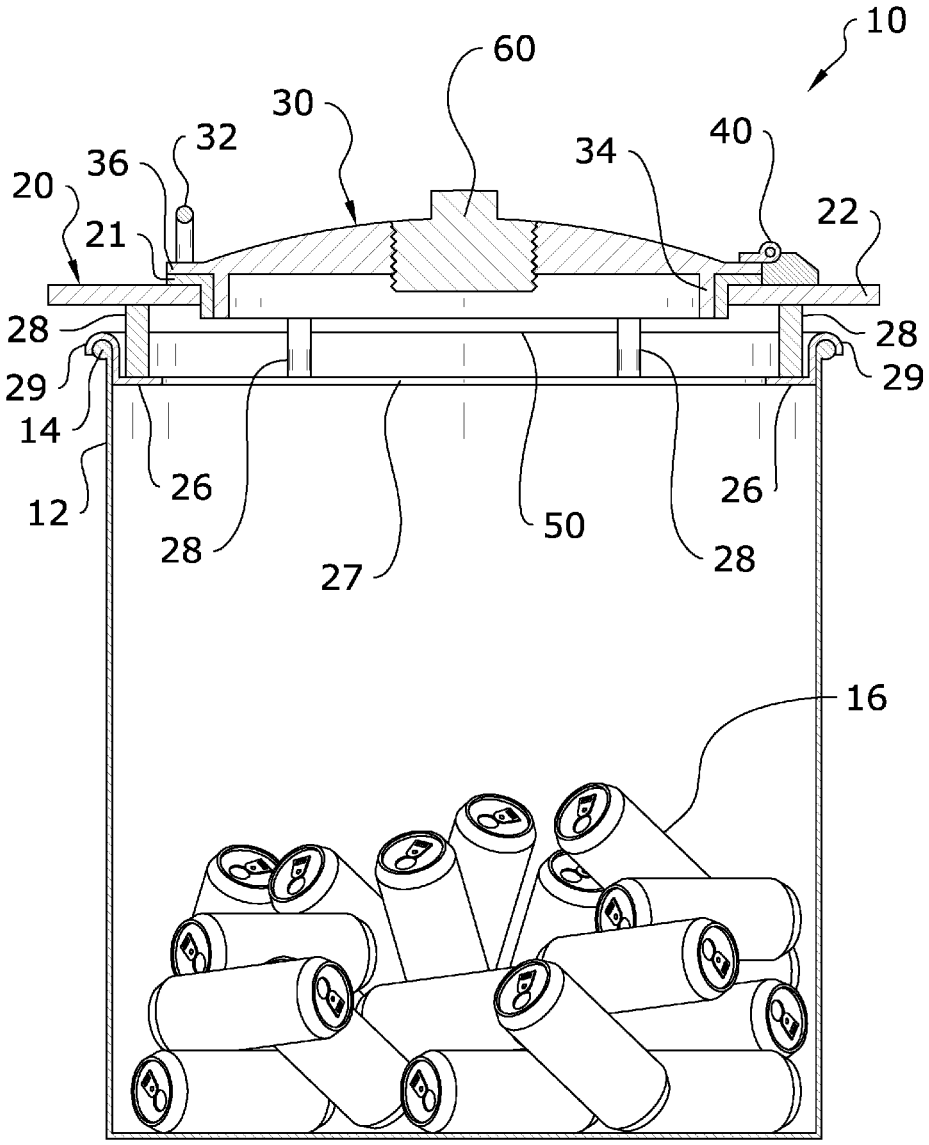
FIG. 10 is a cross sectional view taken along line 10-10.

As illustrated in FIGS. 4, 10 of the drawings, the lower member includes an overlapping portion 29 having a receiver channel facing downwardly forming an inverted C-shaped structure. The receiver channel of the base 20 receives the upper rim 14 of the barrel 12. The receiver channel of the overlapping portion 29 has the same diameter and width as the upper rim 14 of the barrel 12. The overlapping portion 29 preferably extends outwardly past the outer edge of the upper rim 14 as illustrated in FIG. 4 of the drawings. The overlapping portion 29 preferably snugly fits upon the upper rim 14 of the barrel 12 and is retained in position by only gravity.

An extended portion 25 extends downwardly from the overlapping portion 29. The extended portion 25 extends downwardly within the interior of the barrel 12 and beneath the upper rim 14 of the barrel 12 as further shown in FIG. 4 of the drawings. The extended portion 25 preferably extends downwardly in a substantially vertical manner and forms a circular shape.

An interior ring portion 26 extends inwardly from a lower end of the extended portion 25 defining a receiver opening as best illustrated in FIG. 4 of the drawings. The interior ring portion 26 preferably is comprised of a substantially horizontal structure and further preferably defines a circular lower opening 27 sufficient in size to receive the discarded items 16 to be deposited within the barrel 12. The lower opening 27 defined by the interior ring portion 26 is smaller than the opening defined by the upper rim 14 of the barrel 12 as further shown in FIG. 4 of the drawings.

FIGS. 1 through 3 illustrate a first embodiment of the invention wherein the base 20 is positioned upon the barrel 12 without a cover 30, thereby leaving the upper opening 24 exposed to allow for convenient inputting of discarded items 16. The base 20 provides a smaller opening (e.g. 16 inches) and provides protection from the wind compared to leaving the opening of the barrel 12 unprotected.

D. Vent.

The vent 50 extends through the base 20 to provide for ventilation of the interior of the barrel 12 and the discarded items 16. The height of the vent 50 is sufficient to allow for adequate ventilation of the interior of the barrel 12 while low enough to prevent access to the interior of the barrel 12 to animals or humans. It is preferable that the height of the vent 50 be only approximately a couple of inches at the most.

The vent 50 extends through at least a portion of a perimeter of the base 20 and preferably extends completely around the perimeter of the base 20 as illustrated in FIGS. 1 through 12 of the drawings. The vent 50 is preferably comprised of a continuous opening surrounding the perimeter of the base 20 with only the support members 28 positioned within the vent 50. The vent 50 further extends outwardly in a radial manner from between the upper member 22 and the lower member of the base 20, wherein the upper member 22 prevents debris and precipitation from entering the vent 50.

E. Cover.

FIGS. 8 through 12 illustrate a cover 30 that is removably positioned within the upper opening 24 of the base 20 for selectively closing the upper opening 24 and for selectively exposing the upper opening 24 for discarded items 16 to be passed through the upper opening 24 into the interior of the barrel 12.

Figure 8:
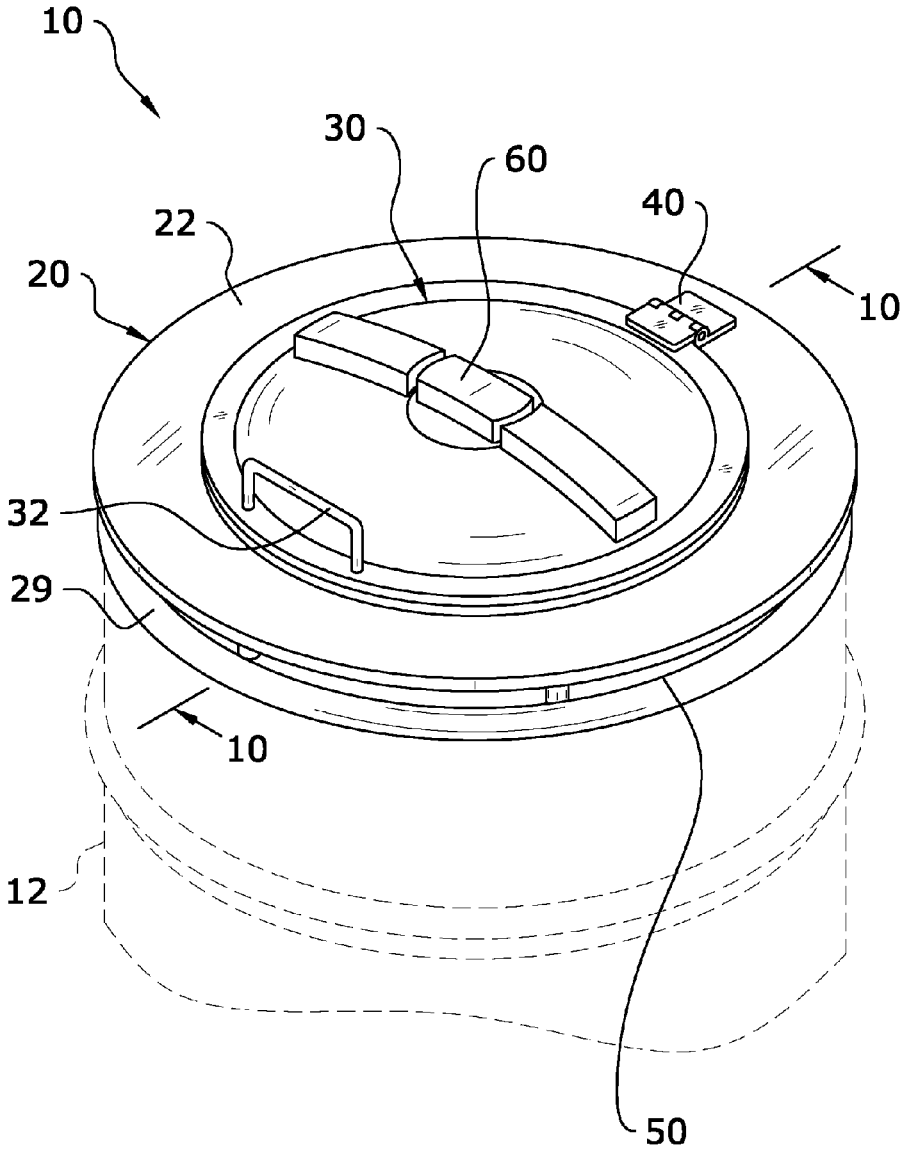
FIG. 8 is an upper perspective view of the base positioned upon a barrel and a cover pivotally connected to the base, wherein the cover is in a closed state.
Figure 9:
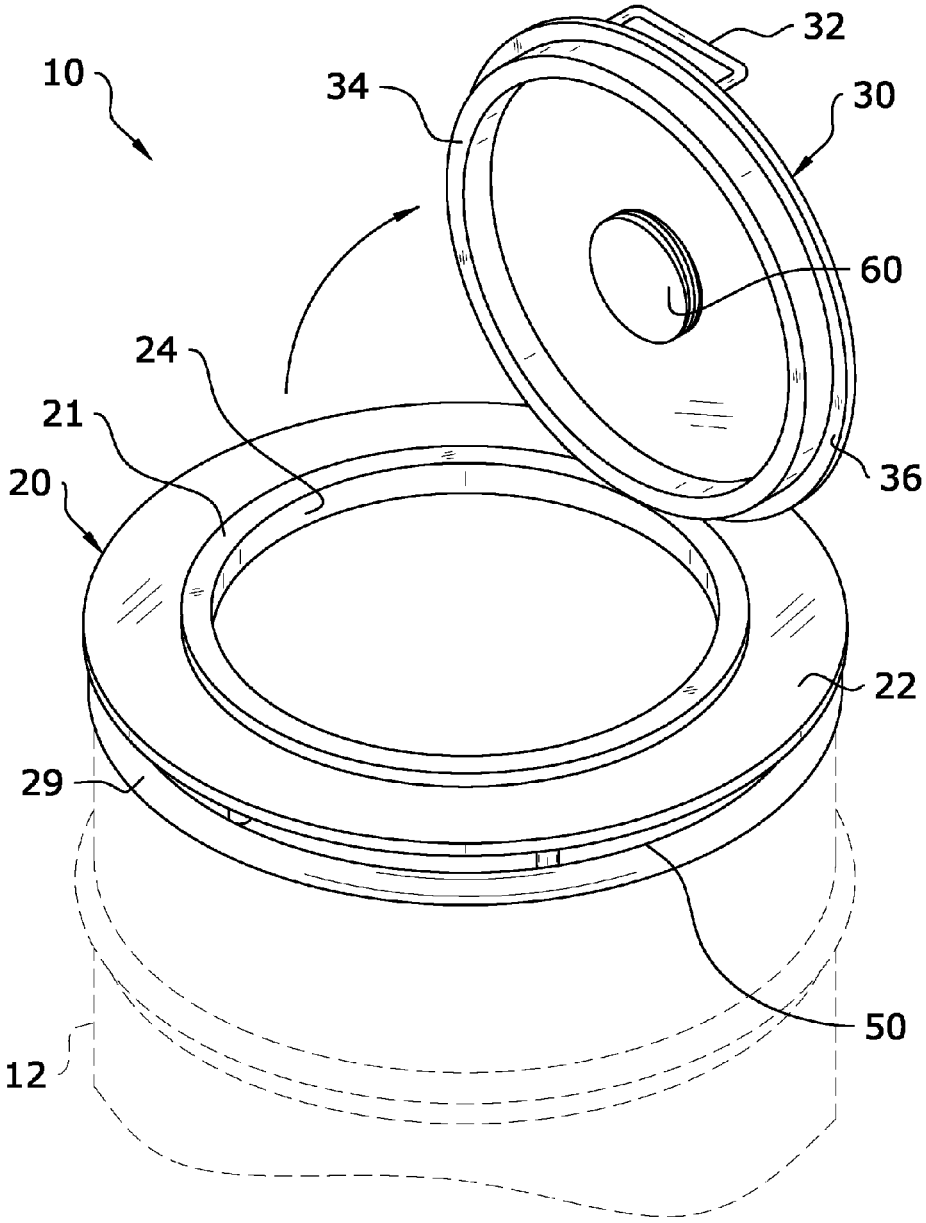
FIG. 9 is an upper perspective view of the base positioned upon a barrel and a cover pivotally connected to the base, wherein the cover is in an open state.

FIGS. 8 through 10 illustrate the cover 30 pivotally connected to the base 20 by a hinge 40. As best illustrated in FIG. 8, the cover 30 preferably includes an end handle 32 positioned adjacent to an end of the cover 30 opposite of the hinge 40.

The cover 30 further preferably includes a lip portion 36 that extends outwardly. The base 20 includes a raised lip 21 surrounding the upper opening 24 to prevent precipitation and other debris from entering the upper opening 24 as illustrated in FIG. 9 of the drawings. The lip portion 36 seals about the upper edge of the raised lip 21 as illustrated in FIG. 10 of the drawings to prevent precipitation and other debris from entering the interior of the barrel 12. It is further preferable that the cover 30 include a lower lip 34 that has an outside width less than the interior width of the upper opening 24 to further seal the cover 30 with respect to the base 20.

Figure 11:
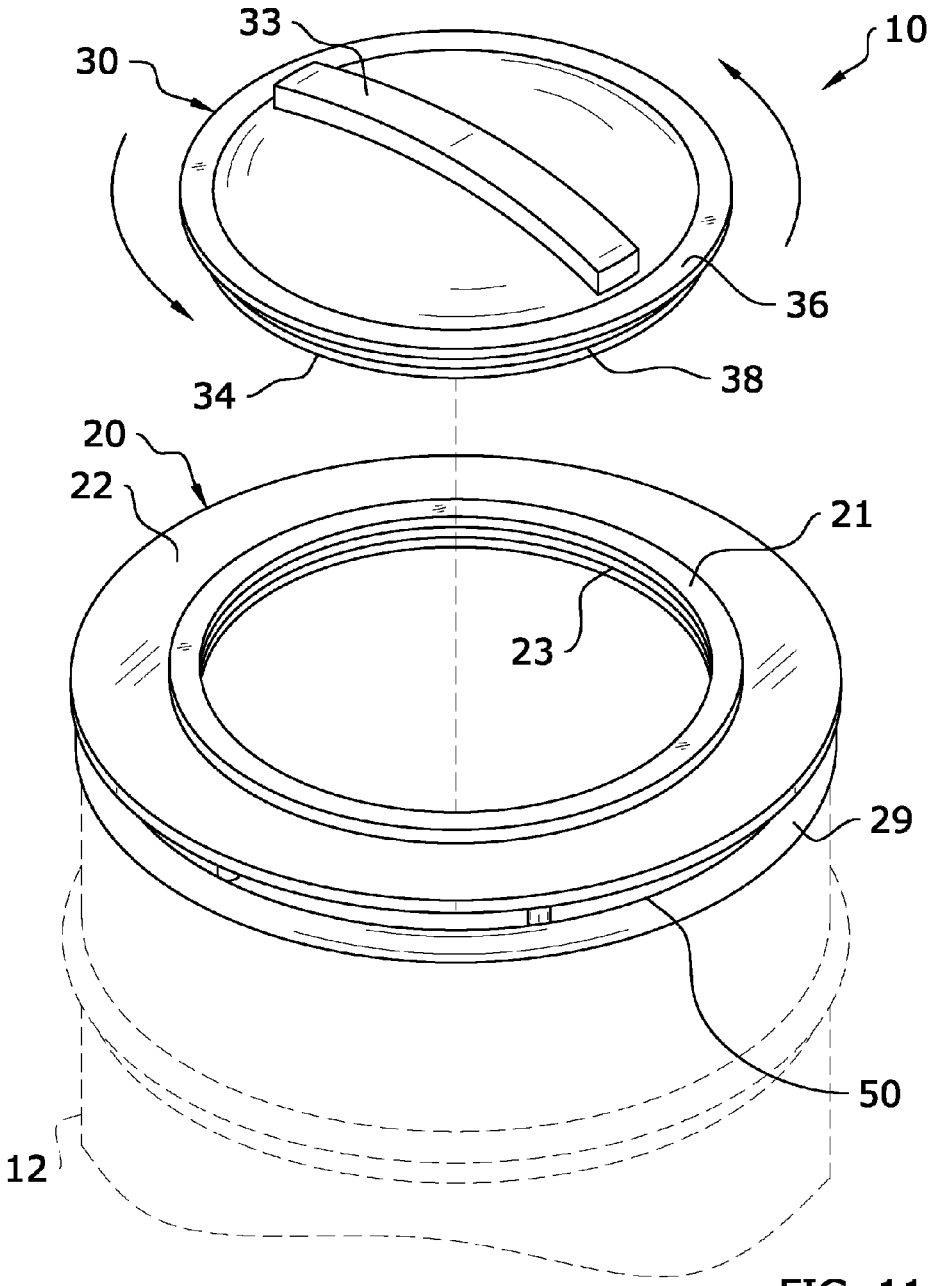
FIG. 11 is an upper perspective view of an alternative embodiment with a cover having male threading to threadably connect to the base.
Figure 12:
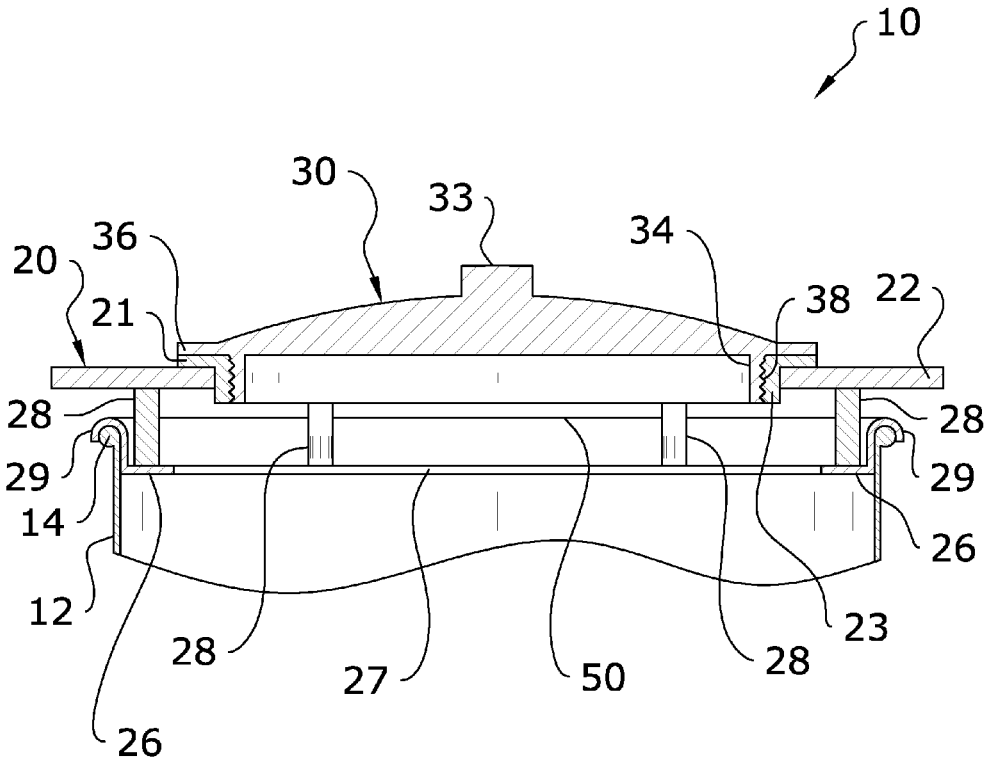
FIG. 12 is a side cutaway view of the alternative embodiment with the cover threadably attached to the base.

FIGS. 11 and 12 illustrate an alternative embodiment wherein the cover 30 includes male threading 38 and the upper opening 24 of the base 20 includes female threading 23. The male threading 38 of the cover 30 threadably connects to the female threading 23 of the upper opening 24 to allow for the cover 30 to be rotated off and on with respect to the base 20 to expose and close the upper opening 24 respectively. A central handle 33 preferably extends along the upper surface of the cover 30 for a user to grasp as shown in FIG. 11 of the drawings.

The cover 30 further may include an access member 60 that may be removed (e.g. threadably, catchably, etc.) from the main body of the cover 30 exposing an access opening as illustrated in FIGS. 8 through 10 of the drawings. The access member 60 is removably positioned within an access opening within the cover 30, wherein the access opening is significantly smaller than the upper opening 24. Small items such as cans and bottles may be dropped through the access opening into the interior of the barrel 12 without having to open the entire cover 30.

F. Operation of Preferred Embodiment.

In use, the user positions the base 20 upon the upper rim 14 of the barrel 12 as illustrated in FIGS. 1, 2, 4, 8, 9, 10, 11 and 12 of the drawings. Individuals place various types of discarded items 16 (e.g. recyclable materials, aluminum cans, plastic bottles, glass bottles, paper, cardboard, waste material etc.) into the barrel 12 by opening the cover 30 as shown in FIGS. 9 and 11 of the drawings. After the discarded items 16 are discarded through the upper opening 24 within the base 20, the user closes the cover 30 to protect the upper opening 24 from the elements. Often times the discarded items 16 will have liquids (e.g. pop, water) within them that need to be evaporated. The vent 50 within the base 20 allows for the ventilation of the interior of the barrel 12 thereby removing the liquids from the interior of the barrel 12. Removal of the liquids also helps reduce the odors and the overall weight within the interior of the barrel 12. Heating of the barrel 12 by the sun, wind and atmospheric pressure changes help facilitate the air exchange through the vent 50 within the base 20.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A ventilated barrel cover system, comprising:

a base, wherein said base is adapted to be positioned upon an upper rim of a barrel;

an upper opening extending through said base, wherein said upper opening is adapted to receive discarded items to be deposited within an interior of the barrel, wherein said base is comprised of a lower member having a lower opening, an upper member including said upper opening, and at least one support member extending between said lower member and said upper member;

wherein said upper member is wider than said lower member;

a vent extending through said base, wherein said vent allows ventilation of the interior of the barrel; and a cover, wherein said cover is removably positioned within said upper opening for selectively closing said upper opening.

2. The ventilated barrel cover system of claim 1, wherein said upper opening is circular shaped.

3. The ventilated barrel cover system of claim 1, wherein said base is comprised of a ring structure.

4. The ventilated barrel cover system of claim 1, wherein said upper member is positioned above said lower member defining said vent.

5. The ventilated barrel cover system of claim 1, wherein said upper member and said lower member are substantially parallel with respect to one another.

6. The ventilated barrel cover system of claim 1, wherein said lower member is comprised of an overlapping portion having a receiver channel, wherein said receiver channel is adapted to receive the upper rim of the barrel.

7. The ventilated barrel cover system of claim 6, wherein said lower member includes an extended portion that extends downwardly from said overlapping portion, and an interior ring portion extending inwardly from a lower end of said extended portion defining a receiver opening, wherein said extended portion is adapted to extend downwardly within the interior of the barrel and beneath the upper rim of the barrel, wherein said at least one support member extends upwardly from said interior ring to said upper member.

8. The ventilated barrel cover system of claim 1, wherein said upper member is wider than the barrel.

9. The ventilated barrel cover system of claim 1, wherein said at least one support member is comprised of a plurality of support members.

10. The ventilated barrel cover system of claim 9, wherein said plurality of support members are distally spaced about a perimeter portion of said lower member.

11. The ventilated barrel cover system of claim 1, wherein said lower opening and said upper opening are concentric with respect to one another.

12. The ventilated barrel cover system of claim 1, wherein said lower opening is larger than said upper opening.

13. The ventilated barrel cover system of claim 1, wherein said vent extends through at least a portion of a perimeter of said base.

14. The ventilated barrel cover system of claim 13, wherein said vent extends completely around said perimeter of said base.

15. The ventilated barrel cover system of claim 1, wherein said cover includes male threading and wherein said upper opening of said base includes female threading, wherein said male threading of said cover threadably connects to said female threading of said upper opening.

16. The ventilated barrel cover system of claim 1, wherein said cover includes a lip portion that extends outwardly and wherein said base includes a raised lip surrounding said upper opening, wherein said lip portion is adapted to rest upon and substantially seal with respect to an upper edge of said raised lip.

17. The ventilated barrel cover system of claim 1, wherein said cover includes an access member, wherein said access member is removably positioned within an access opening within said cover, wherein said access opening is significantly smaller than said upper opening.

18. A ventilated barrel cover system, comprising:

a base, wherein said base is adapted to be positioned upon an upper rim of a barrel;

an upper opening extending through said base, wherein said upper opening is adapted to receive discarded items to be deposited within an interior of the barrel, wherein said base is comprised of a lower member having a lower opening, an upper member including said upper opening, and at least one support member extending between said lower member and said upper member;

wherein said upper member is wider than the barrel;

a vent extending through said base, wherein said vent allows ventilation of the interior of the barrel; and a cover, wherein said cover is removably positioned within said upper opening for selectively closing said upper opening.

19. A ventilated barrel cover system, comprising:

a base, wherein said base is adapted to be positioned upon an upper rim of a barrel;

an upper opening extending through said base, wherein said upper opening is adapted to receive discarded items to be deposited within an interior of the barrel, wherein said base is comprised of a lower member having a lower opening, an upper member including said upper opening, and at least one support member extending between said lower member and said upper member;

wherein said lower member is comprised of an overlapping portion having a receiver channel, wherein said receiver channel is adapted to receive the upper rim of the barrel;

wherein said lower member includes an extended portion that extends downwardly from said overlapping portion, and an interior ring portion extending inwardly from a lower end of said extended portion defining a receiver opening, wherein said extended portion is adapted to extend downwardly within the interior of the barrel and beneath the upper rim of the barrel, wherein said at least one support member extends upwardly from said interior ring to said upper member;

a vent extending through said base, wherein said vent allows ventilation of the interior of the barrel; and a cover, wherein said cover is removably positioned within said upper opening for selectively closing said upper opening.

* * * * *